US005545293A

United States Patent [19]

Huovila et al.

[11] Patent Number: 5,545,293

[45] Date of Patent: Aug. 13, 1996

[54] METHOD AND DEVICE IN THE REGULATION OF A HEADBOX

[75] Inventors: Jyrki Huovila; Ari Linsuri, both of Muurame; Petri Nyberg; Michael Odell, both of Jyväskylä, all of Finland

[73] Assignee: Valmet Corporation, Helinski, Finland

[21] Appl. No.: 269,566

[22] Filed: Jul. 1, 1994

[30] Foreign Application Priority Data

| | | | |
|---|---|---|---|
| Jul. 1, 1993 | [FI] | Finland | 933027 |
| Jun. 13, 1994 | [FI] | Finland | 942780 |

[51] Int. Cl.[6] ..... D21F 1/08

[52] U.S. Cl. ..... 162/212; 162/343; 162/336; 162/258; 162/300; 162/252

[58] Field of Search ..... 162/336, 343, 162/212, 300, 252, 258; 141/18; 57/140

[56] References Cited

U.S. PATENT DOCUMENTS

| | | | |
|---|---|---|---|
| 3,640,063 | 2/1972 | Schmid et al. | 57/140 |
| 3,791,918 | 6/1974 | Koskimies et al. | 162/343 |
| 4,146,425 | 3/1979 | Gutzeit | 162/252 |
| 4,445,974 | 5/1984 | Stenberg | 162/300 |
| 4,637,439 | 1/1987 | Jeans | 141/18 |
| 4,804,441 | 2/1989 | Lyytinen | 162/212 |
| 4,888,094 | 12/1989 | Weisshuhn et al. | 162/198 |
| 4,909,904 | 3/1990 | Kinzler | 162/343 |
| 5,022,965 | 6/1991 | Pitkajarvi | 162/192 |
| 5,133,836 | 7/1992 | Allen | 162/343 |
| 5,316,383 | 5/1994 | Begemann | 366/160 |

FOREIGN PATENT DOCUMENTS

| | | |
|---|---|---|
| 0462472 | 12/1991 | European Pat. Off. . |
| 9115296 | 4/1992 | Germany . |
| 4239845 | 5/1993 | Germany . |
| 4323263 | 1/1994 | Germany . |
| 8601844 | 3/1986 | WIPO . |
| 9322495 | 11/1993 | WIPO . |

*Primary Examiner*—David L. Lacey
*Assistant Examiner*—Calvin Padgett
*Attorney, Agent, or Firm*—Steinberg, Raskin & Davidson P.C.

[57] ABSTRACT

A method and device in the regulation of a headbox. The headbox includes a pulp inlet header, after the pulp inlet header, seen in the pulp flow direction, a distributor manifold whose pipes are opened into an intermediate chamber. The headbox comprises an attenuation chamber placed in connection with the intermediate chamber and, after the intermediate chamber, a turbulence generator having tubes which are opened, at their outlet end, into a discharge duct and, at their inlet end, into the intermediate chamber. In the method, into different positions along the width of the headbox, a pulp suspension flow is introduced, the concentration of this flow is adjustable by combining two component flows. In the method, in the regulation of the concentration of the flow passed into the pulp suspension, two component flows are combined by into the pulp suspension flow introducing an additional flow. The mixing ratio of the combined flow is regulated by adjusting the additional component flow. In the method, the additional component flow is passed into the pulp flow taken out of the inlet header.

44 Claims, 14 Drawing Sheets

I
II
III
10
M
11
11a1.1
11a4.1
S
Q3
X
12
Q1
20a1
21a1
19
E
G
T
D
Q2
B
17
13
13a1.1
13a2.1
13a5.1
13a4.1
13a3.1
Q4
N
16
15
K

METHOD AND DEVICE IN THE REGULATION OF A HEADBOX

BACKGROUND OF THE INVENTION

The present invention relates to a method and device in the regulation of the headbox of a paper/board machine, by means of which method and device it is possible to reliably act upon the grammage profile of the paper reliably across the width of the paper/board web and advantageously, it is also possible to act upon the fiber-orientation profile of the paper/board web across the width of the paper/board web.

As is known from the prior art, the discharge flow of the pulp suspension out of the headbox should have a uniform velocity in the transverse direction of the paper/board machine and. A transverse flow produces distortion of the fiber orientation and adversely affects the quality factors of the paper produced, such as anisotropy of strength and stretch. The level and variation of anisotropy in the transverse direction also affect the printing properties of the paper. In particular, it is an important requirement that the main axes of the directional distribution, i.e. orientation, of the fiber mesh in the paper coincide with the directions of the main axes of the paper and that the orientation is symmetric in relation to these axes.

At the edges of the pulp-flow duct in the headbox, a smaller amount of pulp flows. This edge effect produces a very strong linear distortion in the fiber-orientation profile. Profile faults in the turbulence generator of the headbox usually produce a non-linear distortion in the fiber-orientation profile inside the lateral areas of the flow ducts.

Attempts have been made to compensate for an unevenness of the grammage profile arising from the drying-shrinkage of paper by means of a crown formation of the slice, so that the slice is thicker in the middle of the pulp jet. However, it is a phenomenon in the manufacture of paper that when the paper web is dried, it shrinks in the middle area of the web to a lower extent than in the lateral areas. The shrinkage is typically in the middle of the web about 4% and in the lateral areas of the web from about 5% to about 6%. This shrinkage profile produces a corresponding change in the transverse grammage profile of the web. As a result of the shrinkage, the dry grammage profile of a web whose transverse grammage profile was uniform after the press is changed during the drying so that, in both of the lateral areas of the web, the grammage is slightly higher than in the middle area. As known from the prior art, the grammage profile has been regulated by means of the profile bar so that the profile bar of the headbox is kept more open in the middle area of the headbox than in the lateral areas of the headbox.

By means of this type of arrangement, the pulp suspension is forced to move towards the middle area of the web. However, there circumstances further affect the alignment of the fiber orientation. The main axes of the directional distribution, i.e. orientation, of the fiber mesh should coincide with the directions of the main axes of the paper, and the orientation should be symmetric in relation to these axes. In the regulation of the profile bar, a change in the orientation is produced as the pulp suspension flow receives components in the transverse direction.

Regulation of the lip of the headbox also produces a change in the transverse flows of the pulp jet even though the objective of the regulation is exclusively and only to affect the grammage profile, i.e. the thickness profile of the pulp suspension layer that is fed. Thus, the transverse flows have a direct relationship with the distribution of the fiber orientation.

From the prior art, specific devices are known by whose means attempts are made to regulate the fiber orientation, and other devices are known by whose means attempts are made to regulate the grammage profile of the web. However, when the grammage profile is regulated in a prior art devices by means of the profile bar, the fiber orientation in the web is unavoidably also affected at the same time.

From the prior art, a method is known in the headbox of the paper machine to control the distortion of the fiber orientation in the paper web. In such a method, medium flows are passed into lateral passages placed at the level of the turbulence generator of the headbox, and, by regulating the magnitudes and the mutual proportions of these flows, the transverse flows of the pulp suspension are affected, and thereby the distortion of the fiber orientation is regulated. By means of the flows introduced into the lateral passages, a transverse flow velocity is produced which compensates for the distortion of the fiber orientation.

From the assignee's Finnish Patent Application No. 884408 of earlier date (corresponding to the assignee's U.S. Pat. No. 5,022,965, the specification of which is hereby incorporated by reference herein), a method is known in the headbox of a paper machine to control the distribution of the fiber orientation of the paper web in the transverse direction of the machine. In the method described in FI '408, the transverse velocity component of the discharge jet is regulated by appropriately aligning the turbulence tube of the turbulence generator.

By means of the above mentioned prior art methods for controlling the fiber orientation in the paper web, it is usually possible to control only the linear distortion profiles. The prior art methods are thus suitable for the control of the fiber orientation, but, when they are used, commonly even a large non-linear residual fault remains in comparison with an even distribution of the orientation. The prior art methods are also well suitable for basic regulation of the distortion of the orientation. However, by means of the prior art methods, it is not possible to regulate individual faults which may occur in the orientation in the middle area of the web and which arise, e.g., from defects in the pipe system of the turbulence generator.

A number of methods are also known for the regulation of the profile bar, in which, while the grammage profile is measured, the position of the profile bar in the headbox of the paper machine is changed. In addition, by means of the profile bar, the thickness of the pulp suspension discharged onto the wire, and thereby, the grammage of the paper web, are affected. In the manner described above, this regulation produces faults in the orientation because, by means of the regulation, the flow is throttled elsewhere, whereby components of transverse velocity are produced in the flow.

In the invention described in the assignee's Finnish Patent No. 50,260 (corresponding to U.S. Pat. No. 3,791,918), the headbox has been divided across its width, in a direction transverse to the main flow direction, into compartments by means of partition walls. In this headbox, in an individual compartment, there is at least one inlet duct for the passage of a component flow to feed diluting water into the pulp flow.

OBJECTS AND SUMMARY OF THE INVENTION

Accordingly, it is an object of the present invention to provide novel solutions for the problems discussed above.

It is also an object of the present invention to provide a new and improved method and device by whose means the consistency of the pulp suspension at different positions of width of the web, i.e., in the transverse direction of the web, can be reliably regulated so that the diluting flow remains at the position of width into which it is introduced and is not shifted in the cross machine direction into another compartment.

The aim of the consistency-regulation of grammage is to eliminate the interdependence between the transverse grammage profile and the fiber orientation profile. When the transverse profile of grammage is regulated by profiling the consistency, for example, when O-water is used, the maximal amount of diluting water is 50% of the overall flow quantity in the consistency zone. In order that this water amount should not produce transverse flows and eliminate the object of the consistency regulation, the amount of diluting water must be compensated for so that the flow quantity coming from the turbulence generator is invariable and constant in the transverse direction of the machine. The mixed/consistency-regulated flow quantity should thus be kept invariable and constant.

In a preferred embodiment of the method and device in accordance with the invention, the diluting liquid is passed directly into the turbulence tube, into its mixing chamber. The introduced diluting flow displaces the pulp flow that has been introduced from the intermediate chamber and that is combined with the diluting flow by its own quantity. Thus, the sum flow remains invariable.

In a second preferred embodiment of the invention, it is also possible to regulate the flow quantities in different positions of width of the headbox, i.e., in the transverse direction of the headbox, and, thus, it is possible to regulate the fiber orientation in the overall flow in the direction of width of the paper machine. In this second preferred embodiment, the flow is introduced, on the whole, into the pipe system after the pulp inlet header, and into the system of distributor pipes. Further, the headbox is divided or partitioned into compartments in the direction of width, and a pulp flow and a diluting flow are passed into each compartment, and after the point of combination (of the pulp flow and the diluting flow) there is an overflow into an attenuation chamber. In this manner, at each position of width, besides adjustment of the grammage of the paper, it is also possible to regulate the pressure of the flow, i.e. the flow quantity or rate, at each particular position of width, and thus, the fiber orientation of the paper.

In the following, the invention will be described in detail with reference to some exemplifying embodiments of the invention illustrated in the figures in the accompanying drawing, the invention being by no means strictly confined to the details of the embodiments.

BRIEF DESCRIPTION OF THE DRAWINGS

The following drawings are illustrative of embodiments of the invention and are not meant to limit the scope of the invention as encompassed by the claims.

FIG. 5A is a schematic illustration of the headbox of a paper/board machine, into which headbox O-water is passed along a duct of its own so as to regulate the mixing ratio at a certain position of width of the headbox and in which headbox an intermediate chamber comprises overflows so as to keep the flow quantity invariable as the mixing ratio is regulated.

DETAILED DESCRIPTION OF THE INVENTION

Figure 1A:
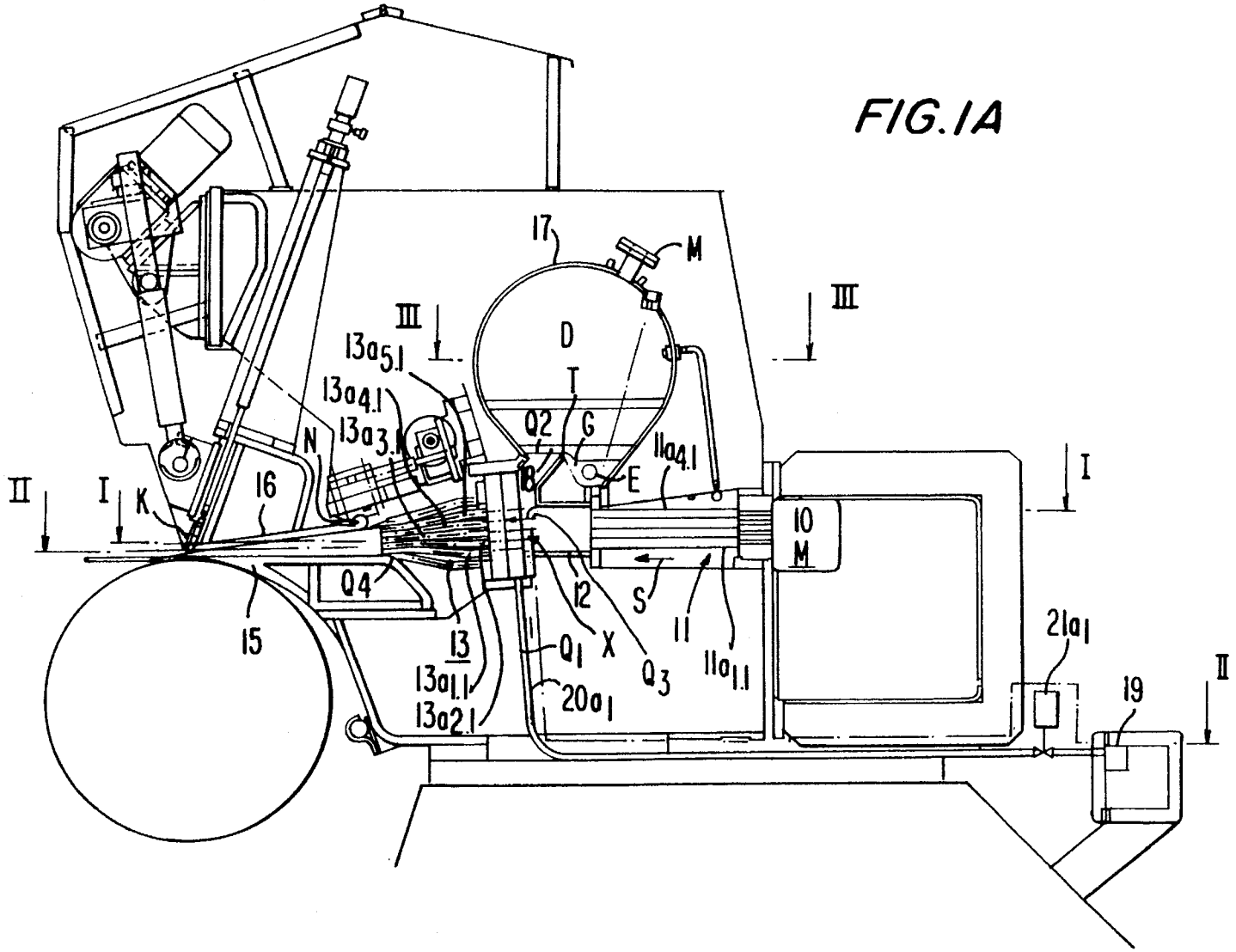
FIG. 1A is a sectional side view of the headbox of a paper/board machine in accordance with the invention, into which O-water is passed along a duct of its own.

Referring to the accompanying drawings wherein like reference numerals refer to the same elements, FIG. 1A shows the headbox of a paper/board machine in accordance with the invention, which headbox comprises, proceeding in the flow direction S of the pulp suspension M, an inlet header 10, a distributor manifold 11, in which there are distributor pipes $\mathbf{11}a_{1.1}$,$\mathbf{11}a_{1.2}$, . . . ,$\mathbf{11}a_{2.1}$,$\mathbf{11}a_{2.2}$, . . . placed one above the other and alongside one another, an intermediate chamber 12, a turbulence generator 13, which comprises a number of turbulence tubes $\mathbf{13}a_{1.1}$,$\mathbf{13}a_{1.2}$, . . . ,$\mathbf{13}a_{2.1}$,$\mathbf{13}a_{2.2}$, . . . placed side by side and alongside one another, and a discharge duct 14, into which the turbulence tubes $\mathbf{13}a_{1.1}$,$\mathbf{13}a_{1.2}$, . . . , $\mathbf{13}a_{2.1}$,$\mathbf{13}a_{2.2}$, . . . of the turbulence generator 13 are opened. The discharge duct 14 is defined by a stationary lower-lip wall 15 and by an upper-lip wall 16 pivoting around an articulated joint N. In the following, when the invention is described and when a paper machine is spoken of, it is obvious that a board machine and its headbox may also be concerned.

Further, the headbox in accordance with the present invention comprises an attenuation chamber 17 which opens into the intermediate chamber 12. The attenuation chamber 17 extends across the entire width of the machine, i.e., the transverse direction of the headbox, and the intermediate chamber 12 communicates through a duct 18 with an interior space D of the attenuation chamber 17. When the pressure in the space D is regulated, the pressure level of the pulp M present in the intermediate chamber 12 is also regulated, e.g., possibly being maintained at the invariable constant level determined by the attenuation chamber 17. As shown in FIG. 1A, an overflow $Q_2$ is provided through the duct 18 into the attenuation chamber 17. Over the overflow threshold T, the flow $Q_2$ enters into a trough G and further is displaced out of the trough G through end ducts E. The pressure is passed into the space D through a flange joint M.

The equalizing chamber 17 comprises an inner pressure space D, to which a flow Q is provided for the pulp M out of the intermediate chamber 12. Pressure is introduced into the space D in the equalizing chamber 17, and the discharge of the pressure out of the space D is regulated by means of a separate valve. Thus, by means of the pressure present in the space D, the level of the pulp M passed into the equalizing chamber (flow $Q_2$) in the space D is regulated, and so also the pressure that acts further upon the pulp M in the intermediate chamber 12. At both ends of the trough G placed underneath the attenuation chamber 17, there are drain ducts E, the flow $Q_2$ into the equalizing chamber 17 passing further out through the trough G and back to the pulp circulation. By means of the flow $Q_2$, the excess amount of the pulp M is removed from the intermediate chamber 12 that must be displaced when a diluting component flow $Q_1$ is introduced into the mixing point in order that the combined flow ($Q_1$+$Q_3$) remains at its invariable value.

Figure 1B:
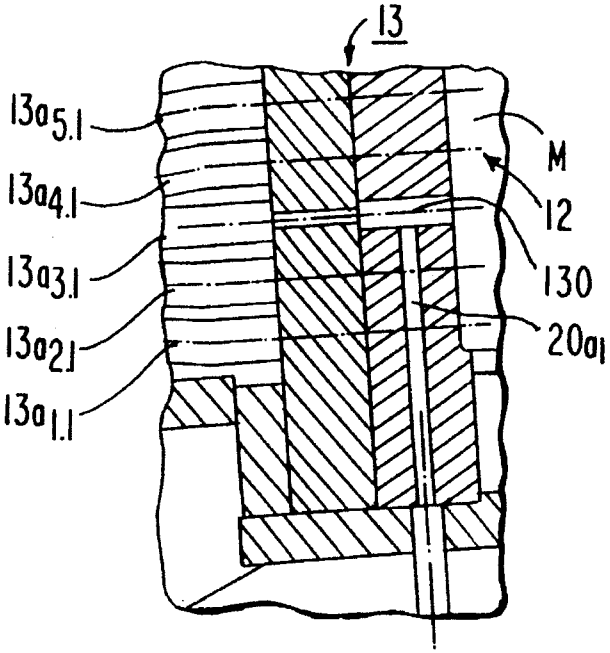
FIG. 1B shows the area X in FIG. 1A.
Figure 1C:
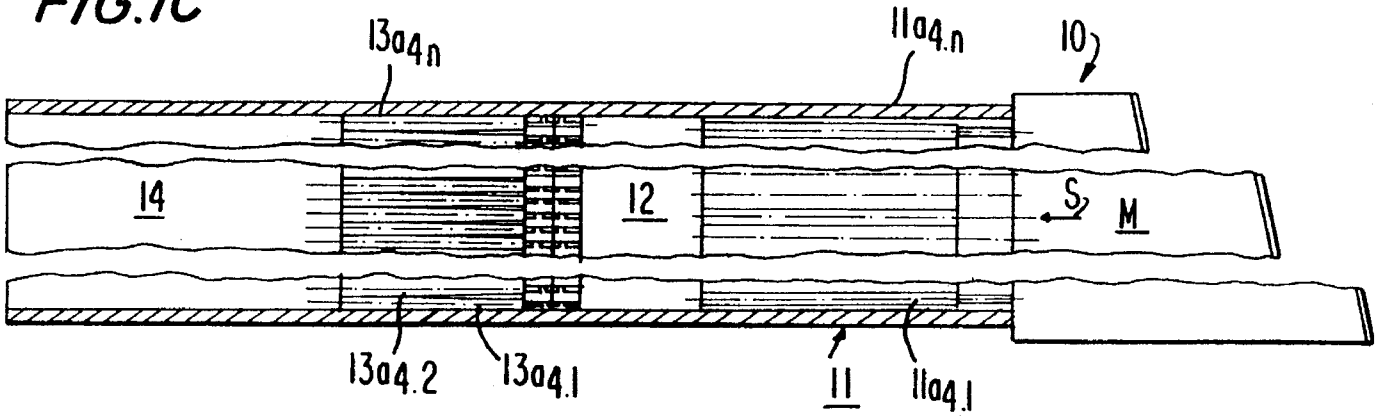
FIG. 1C is a sectional view, partly in section, taken along the line I—I in FIG. 1A.
Figure 1E:
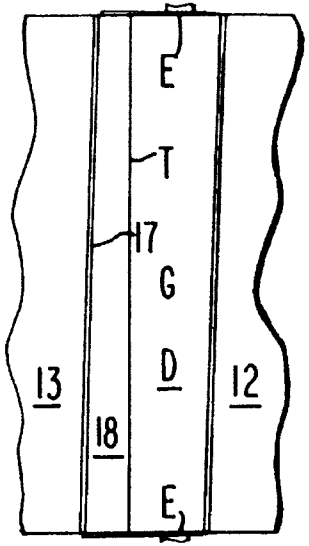
FIG. 1E is a sectional view taken along the line III—III in FIG. 1A.

FIG. 1E is a sectional view taken along the line III—III in FIG. 1A. As shown in FIG. 1E, the equalizing chamber 17 extends across the entire machine width and, thus, from all positions of width of the equalizing chamber, there is a duct connection 18 into the intermediate chamber 12 extending across the machine width. The turbulence generator 13 is placed expressly after the intermediate chamber 12.

In accordance with the present invention, a diluting component flow having subcomponent flows $Q_{1.1}$,$Q_{1.2}$, . . . ,$Q_{1.n}$ is passed in a headbox of the sort mentioned above into the turbulence generator 13. Each diluting subcomponent flow $Q_{1.1}$,$Q_{1.2}$, . . . , $Q_{1.n}$ is passed into different positions of width (in the transverse direction of the headbox) in the turbulence generator 13, preferably into respective turbulence tubes 13$a_{3.1}$,13$a_{3.2}$, . . . ,13$a_{3.n}$ in the middle level. In this manner, by means of the additional flow, i.e. the diluting subcomponent flows $Q_{1.1}$,$Q_{1.2}$, . . . ,$Q_{1.n}$ passed into the compartment formed by the respective tube 13$a_{3.1}$,13$a_{3.2}$, . . . ,13$a_{3.n}$ placed in that position of width, the grammage of the paper is regulated at the position of width concerned as the additional flow is mixed, at each particular position of width, with the pulp M, constituted by its subcomponent flows $Q_{3.1}$,$Q_{3.2}$, . . . ,$Q_{3.n}$ which has been passed out of the intermediate chamber 12 into the turbulence tube 13$a_{3.1}$, 13$a_{3.2}$, . . . , 13$a_{3.n}$ in the turbulence generator 13.

The turbulence generator 13 shown in FIG. 1A comprises a number of turbulence 25 tubes placed side by side in the direction of width and in the vertical direction. The turbulence tubes 13$a_{3.1}$,13$a_{3.2}$, . . . , 13$a_{3.n}$ of the middle level are connected with an additional-flow duct 20$a_1$,20$a_2$, . . . ,20$a_n$, preferably a O-water duct and preferably also a pipe. Each flow duct 20$a_1$,20$a_2$, . . . , 20$a_n$ comprises a valve 21$a_1$,21$a_2$, . . . ,21$a_n$ by whose means the throttle of the additional diluting subcomponent flows $Q_{1.1}$,$Q_{1.2}$, . . . ,$Q_{1.n}$ are regulated. In addition, the flow velocity is thus regulated and the flow quantity is regulated that is passed out of the diluting-water inlet header 19 into the turbulence generator 13 and into each particular compartment constituted by the tube 13$a_{3.1}$,13$a_{3.2}$, . . . , 13$a_{3.n}$. When the additional diluting subcomponent flows $Q_{1.1}$,$Q_{1.2}$, . . . , $Q_{1.n}$ enter into the respective turbulence tubes 13$a_{3.1}$,13$a_{3.2}$, . . . , 13$a_{3.n}$, it is mixed in the mixing chamber 130 of the turbulence tube with a respective one of the pulp M subcomponent flows $Q_{3.1}$,$Q_{3.2}$, . . . , $Q_{3.n}$ passed out of the intermediate chamber. However, in accordance with the invention, it is possible that only one set of respective subcomponent flows, e.g., $Q_{1.1}$ and $Q_{3.1}$, are mixed together in a regulation proportion.

In accordance with the present invention, the amount of additional component flow $Q_1$ that is introduced is reduced from the flow quantity $Q_3$ of the pulp M passed out of the intermediate chamber 12. Thus, the sum flow $Q_4$ (=$Q_1$+$Q_3$) remains invariable during the regulation while the mixing ratio is regulated by regulation of the additional flow by means of the respective valves 21$a_1$,21$a_2$, . . . ,21$a_n$. The excess flow of $Q_3$ is passed as the flow $Q_2$ into the attenuation chamber D and further out of that chamber and back to the pulp circulation.

FIG. 1B is a separate illustration of the area X in FIG. 1A. Into the turbulence tubes in the middle layer of the turbulence generator 13, a pulp component flow $Q_3$ having a normal concentration enters from the intermediate chamber 12 of the headbox. In the turbulence tubes in the turbulence generator 13, each additional component flow $Q_1$ is mixed efficiently with the pulp component flow $Q_3$. The additional subcomponent flows $Q_{1.1}$,$Q_{1.2}$, . . . , $Q_{1.n}$ are passed into the mixing chamber 130 in the turbulence tubes of the turbulence generator 13. By means of the mixing chamber 130, uniform mixing of the component flows $Q_1$ and $Q_3$ is permitted, and the uniform pressure maintained in the intermediate chamber 12 is passed to the mixing point. The quantity of the combined component flows ($Q_1$+$Q_3$) remains invariable, while the mixing ratio is regulated by means of the additional component flow $Q_1$.

In the illustrated embodiment of the invention, the middle layer in the turbulence generator is the layer that is used as the regulation layer, in which the additional flow, preferably a water flow, and the flow of the pulp (M) having an average concentration coming out of the intermediate chamber 12 are combined. In such a case, the flow of regulated concentration is passed through the turbulence generator 13, and the flow, denoted now by $Q_{4.1}$,$Q_{4.2}$, . . . , $Q_{4.n}$ joins, in the vertical direction, the other, non-regulated flows of the pulp (M) coming out of the other tubes in the turbulence generator. At each position across the width of the web, the middle layer operates as the layer that regulates the grammage of the web.

The headbox in accordance with the invention is regulated so that, during operation, the grammage is regulated expressly by means of regulation of the additional subcomponent flows $Q_{1.1}$,$Q_{1.2}$, . . . , $Q_{1.n}$. Thus, during running, the profile bar is not displaced and the systems of control and monitoring of the profile bar K are not required to be maintained. If there is a profile bar K, it is used just at the beginning of the run for advance regulation of the fiber orientation. The profile bar is thus almost never used for regulation of the grammage. The profile bar K comprises adjusting spindles with infrequent spacing and manual operation.

The additional component flow $Q_1$ is preferably a flow that contains water alone or a so-called O-water flow. The additional flow $Q_1$ may also be a pulp flow whose concentration differs, on the whole, from the average concentration of the pulp suspension in the headbox and, thus, from the concentration of the component flow $Q_3$.

FIG. 1C is a sectional view taken along the line I—I in FIG. 1A. Each additional-flow duct 20$a_1$,20$a_2$ . . . , preferably a pipe, comprises a valve 21$a_1$,21$a_2$ . . . , in which case it is possible, in the direction of width of the paper machine, to adjust the desired mixing ratio for the flows $Q_{4.1}$,$Q_{4.2}$, . . . , $Q_{4.n}$ each position of width, which flow, as it comes out of the turbulence generator 13 out of its turbulence tube 13$a_1$,13$a_2$, . . . acts further as a regulation flow at the desired location of width of the pulp suspension jet.

Figure 1D:
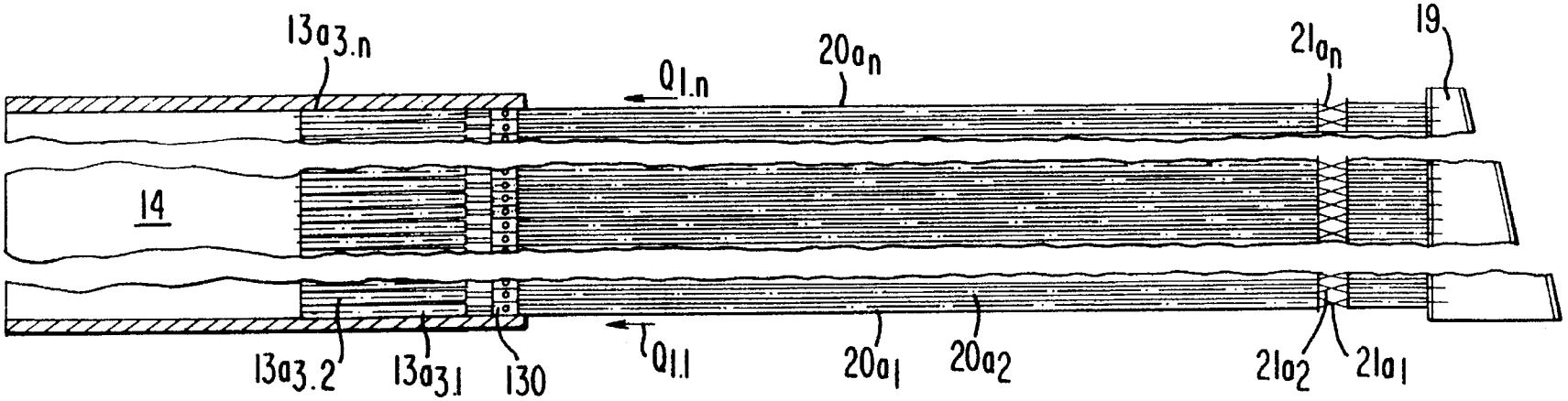
FIG. 1D is a sectional view, partly in section, taken along the line II—II in FIG. 1A.

FIG. 1D is a sectional view taken along the line II—II in FIG. 1A. Out of the diluting inlet header 19, the diluting liquid, preferably diluting water, is passed into the ducts 20$a_1$,20$a_2$. . . , and by means of the valve 21$a_1$,21$a_2$. . . placed in each duct, preferably a pipe, the diluting flow is regulated by throttling the flow in accordance with the regulation of the valve.

FIG. 1E is a sectional view of the attenuation chamber 17 shown in FIG. 1A. As shown in FIG. 1E, the attenuation chamber 17 extends across the entire machine width.

Figure 2A:
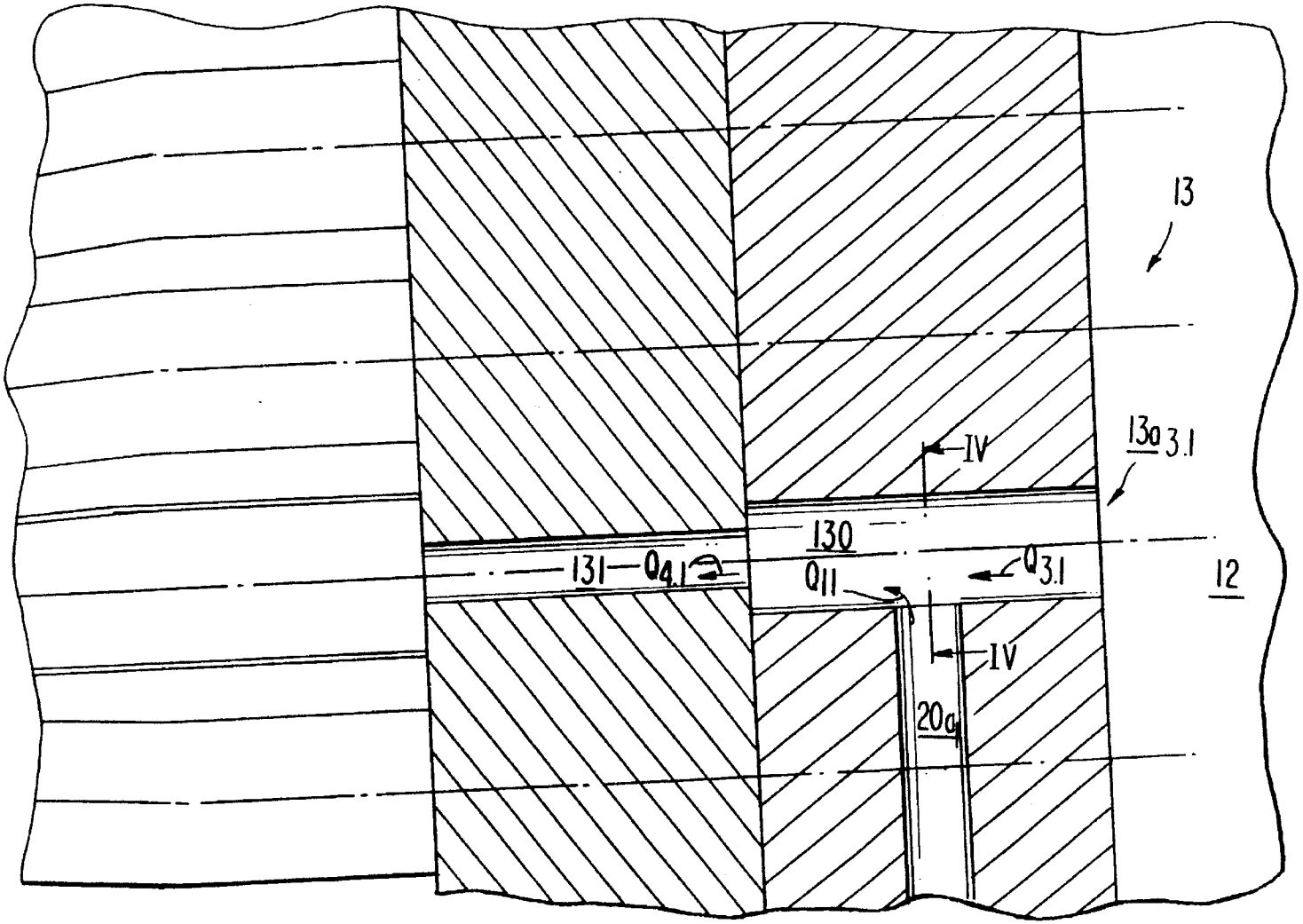
FIG. 2A shows the construction of the mixing chamber of a turbulence tube in the turbulence generator on an enlarged scale.

FIG. 2A is an enlarged illustration of the embodiment shown in FIG. 1B. From the intermediate chamber 12, a flow $Q_{3.1}$ passes into the mixing chamber 130 in the turbulence tube 13$a_{3.1}$ of the turbulence generator 13. Into the mixing chamber, a flow duct 20$a_1$ is provided for the diluting flow. In the embodiment of FIG. 2A, the flow duct joins the mixing chamber halfway in relation to the length of the mixing chamber. The sectional flow area of the mixing chamber 130 in the direction of the flow S (arrow S) is $A_1$, and this area is substantially larger than the sectional flow area $A_2$ of the duct portion 131 following after the mixing chamber in the turbulence tube in the turbulence generator.

Figure 2B:
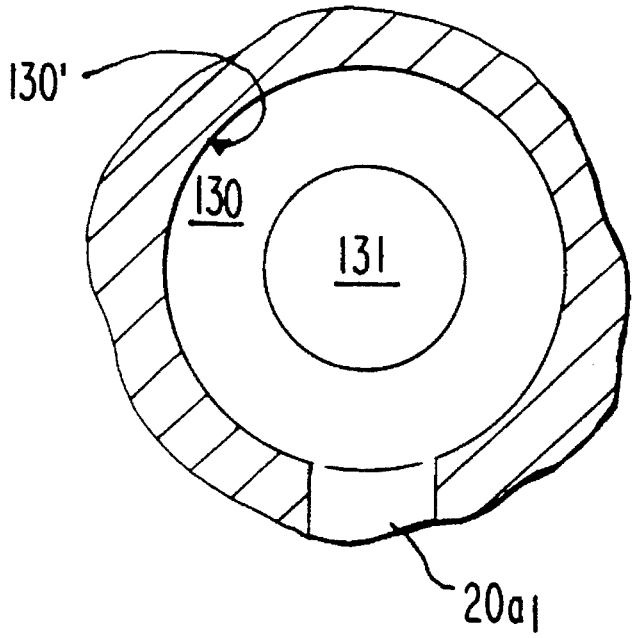
FIG. 2B is an enlarged sectional view taken along the line IV—IV in FIG. 2A.

FIG. 2B is a sectional view taken along the line IV—IV in FIG. 2A.

Figure 3:
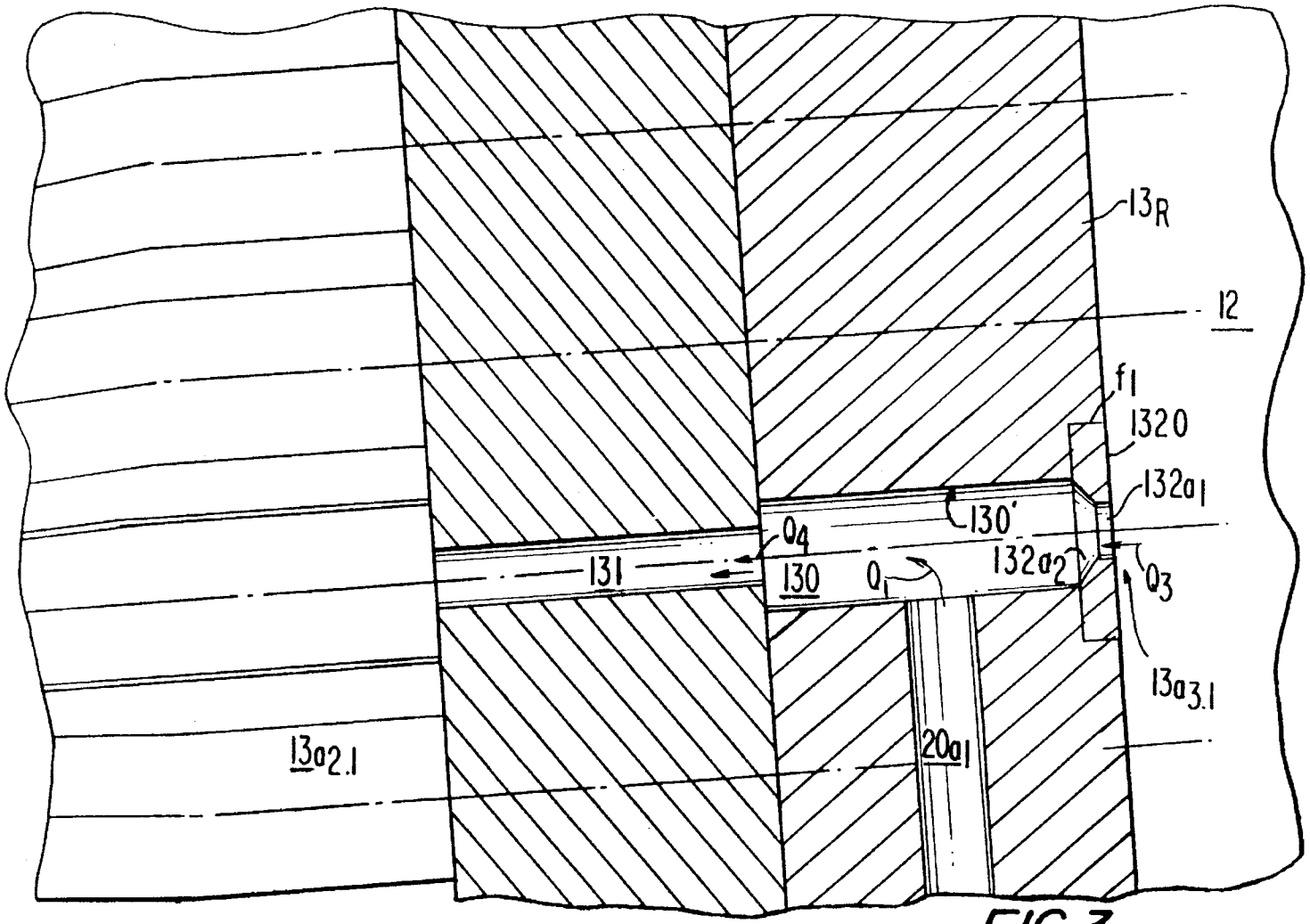
FIG. 3 shows a second embodiment related to the mixing chamber of a turbulence tube.

FIG. 3 shows a second preferred embodiment of the construction related to the mixing chamber. A flange piece 1320 comprises a flow duct 132. The flow duct 132 comprises a straight duct portion 132$a_1$ having a circular section and therein a sectional flow area $A_3$ and a conically widening duct portion 132$a_2$, which is connected with walls 130' of the mixing chamber 130. The flow duct 132 is placed between the intermediate chamber 12 and the mixing chamber 130. The sectional flow area $A_3$ is substantially smaller than the sectional flow area $A_3$ of the mixing chamber 130. The flange piece 1320 is connected, by means of a press fitting or a threaded joint, with the recess $f_1$ that has been made into the face of the frame 13R of the turbulence generator 13 defined by the intermediate chamber 12. Also in this embodiment, the mixing chamber 130 is followed by a duct portion 131 in the turbulence tube, whose sectional flow area is substantially smaller than the sectional flow area of the mixing chamber 130.

Figure 4B:
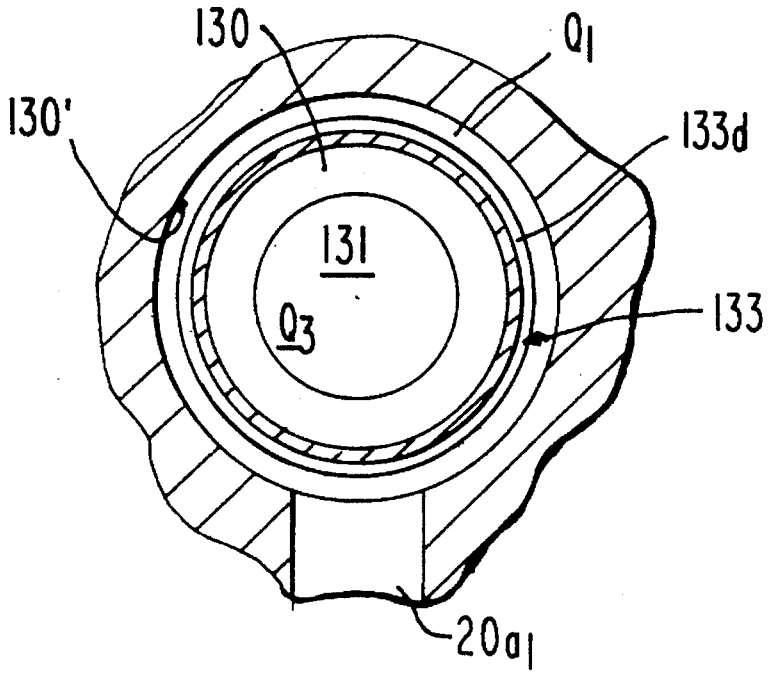
FIG. 4B is an enlarged sectional view taken along the line V—V in FIG. 4A.
Figure 4A:
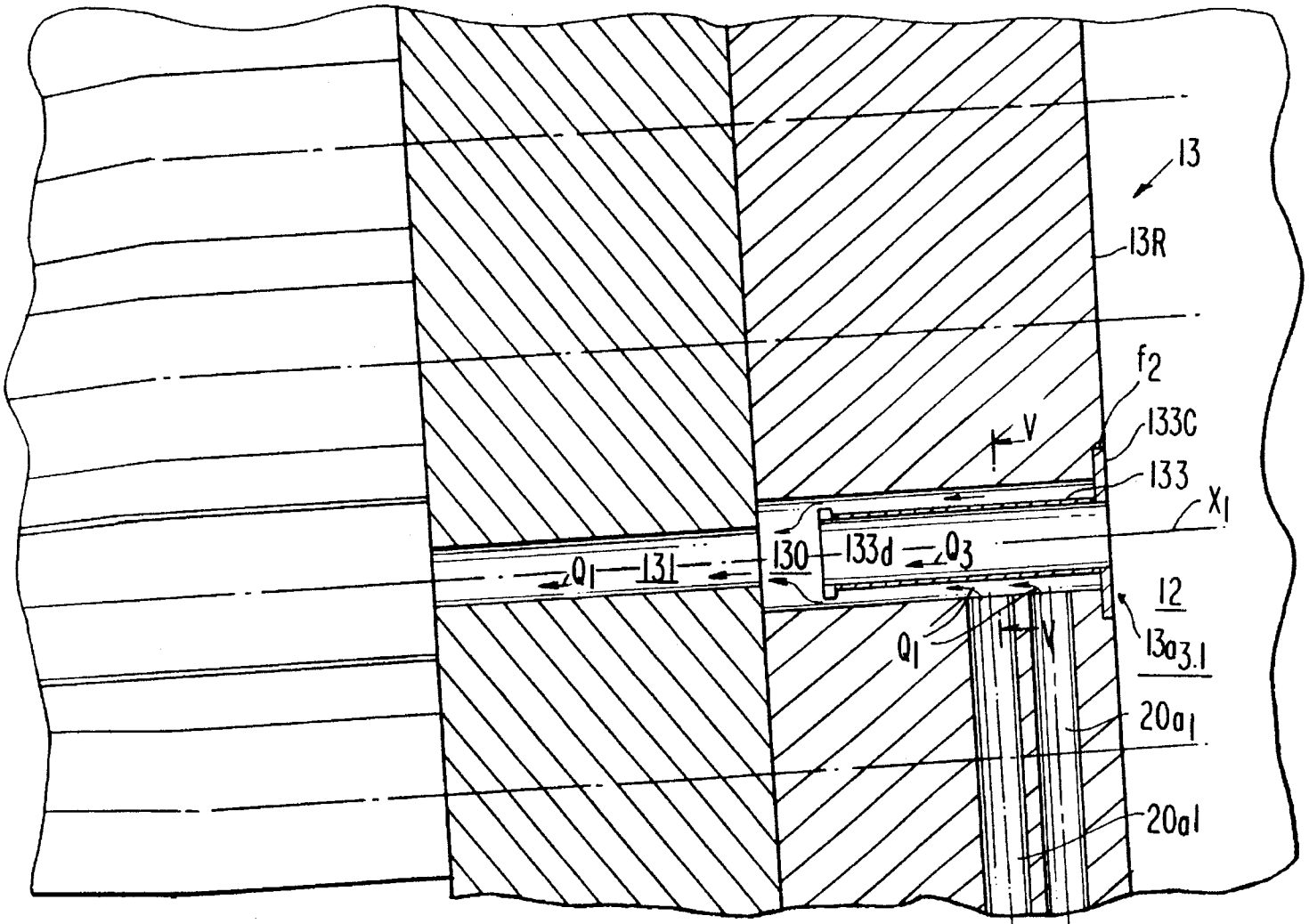
FIG. 4A shows a third preferred embodiment of the invention related to the mixing chamber of a turbulence tube in the turbulence generator.

FIG. 4A shows an embodiment related to the mixing chamber, wherein a pipe or duct 133 extends from the intermediate chamber 12 into the mixing chamber 130. The pipe 133 extends into the mixing chamber 130 so that the pipe is opened in the end of the mixing chamber 130 and is placed centrally on the central axis $X_1$ of the mixing chamber 130. The flow $Q_3$ from the intermediate chamber 12 enters through the pipe 133 into the mixing chamber 130. On its outer face 133', the pipe 133 comprises a throttle flange 133*d*, preferably an annular flange, which projects from the outer face and by whose means the diluting flow $Q_1$ is throttled. The annular flange 133*d* is placed on the circular circumference of the pipe 133. The diluting flow $Q_1$ is passed into the space between the pipe 133 face 133' and the mixing-chamber 130 face 1301, as shown in FIG. 4, along two diluting ducts 20$a_1$',20$a_1$. It is understood that there may be just one diluting-flow duct. In view of considerations of space, it is possible to use two ducts in the way shown in FIG. 4. Also, the pipe 133 comprises a flange 133*c*, preferably an annular flange, at its end, by means of which flange the pipe is connected with a recess $f_2$ in the frame 13R of the turbulence generator. The joint is accomplished either by means of a press fitting or by means of a threaded joint. It can also be accomplished by gluing. The front face of the flange 133*c* is placed facing the intermediate chamber 12.

FIG. 4B is a sectional view taken along the line V—V in FIG. 4A. The flow $Q_1$ out of the additional-flow duct 20$a_1$ passes annularly to the end of the pipe 133 bypassing the flange 133*d* of the pipe. The flows $Q_3$ and $Q_1$ are combined in the mixing chamber 130 at the end of the pipe 133.

Figure 5A:
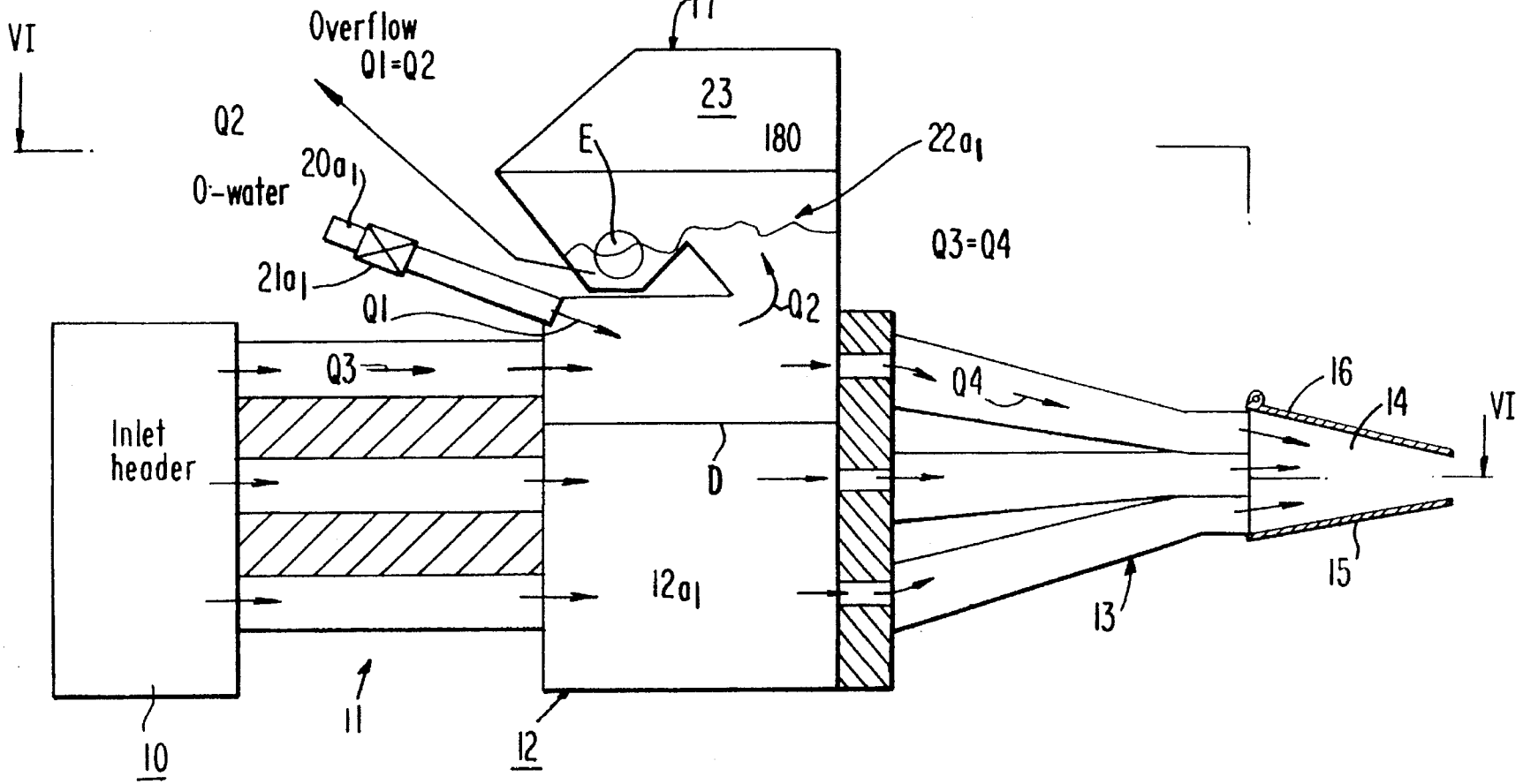
FIG. 5A shows an embodiment of the invention in which the diluting flow is passed into the system of distributor pipes.

FIG. 5A shows the headbox of a paper/board machine in accordance with the invention, which headbox comprises, proceeding in the flow direction S of the pulp suspension M, an inlet header 10, a distribution manifold 11, an intermediate chamber, i.e., in the present case, a mixing chamber 12, a turbulence generator 13, which comprises a number of turbulence tubes 13$a_{1.1}$,13$a_{2.1}$, . . . ,13$a_{1.2}$, 13$a_{2.2}$, . . . placed side by side and one above the other, and a discharge duct 14, into which the turbulence tubes 13$a_{1.1}$,13$a_{2.1}$, . . . , 13$a_{1.2}$, 13$a_{2.2}$, . . . of the turbulence generator 13 are opened. The discharge duct 14 is defined by a stationary lower-lip wall 15 and by an upper-lip wall 16 pivoting around an articulated joint. In the following, when the invention is described and when a paper machine is spoken of, it is obvious that a board machine and its headbox may also be concerned.

In the construction as shown in FIG. 5A, the intermediate chamber 12 has been divided or partitioned, in the direction of width of the headbox of the paper machine (in the transverse direction), into a number of zones or blocks 12$a_1$,12$a_2$, . . . ,12$a_n$ placed side by side. Each block 12$a_1$,12$a_2$, . . . ,12$a_n$ is connected with a respective additional-flow duct 20$a_1$,20$a_2$, . . . ,20$a_n$, preferably a O-water duct and preferably a pipe. Each flow duct 20$a_1$,20$a_2$, . . . ,20$a_n$ comprises a valve 21$a_1$,21$a_2$, . . . ,21$a_n$, by whose means the throttle of the additional component flow $Q_1$ and, thus, its velocity and the flow quantity that is passed into the intermediate chamber 12, into its zone 12$a_1$,12$a_2$, . . . ,12$a_n$ concerned at each particular time are regulated.

Each zone 12$a_1$,12$a_2$, . . . ,12$a_n$ is connected with a respective distribution pipe 11$a_1$,11$a_2$, . . . of the distribution manifold 11. From the inlet header 10, a pulp flow of average concentration is passed through the distribution pipe 11$a_1$,11$a_2$, . . . into the intermediate chamber 12 of the headbox of the paper machine, into the various zones 12$a_1$,12$a_2$, . . . ,12$a_n$ in the chamber 12. Each additional subcomponent flow $Q_1$ is introduced through the duct 20$a_1$, 20$a_2$, . . . ,20$a_n$ at a high velocity, whereby it is mixed in the zones 12$a_1$,12$a_2$, . . . ,12$a_n$ in the intermediate chamber 12 efficiently with the pulp component flow $Q_3$. Out of the zones 12$a_1$,12$a_2$, . . . ,12$a_n$ the mixed component flow $Q_4$ is passed into the turbulence generator 13 into the turbulence tubes 13$a_1$,13$a_2$,13$a_3$, . . . ,13$a_n$ in its upper row.

In the mixing chamber 12, each mixing zone 12$a_1$,12$a_2$, . . . ,12$a_n$ has been arranged as a compartment in the direction of width of the headbox so that each zone $12a_1$, $12a_2$, . . . ,$12a_n$ is separate and does not communicate with the adjacent zone. Moreover, from each zone $12a_1$,$12a_2$, . . . ,$12a_n$, an overflow $22a_1$,$22a_2$, . . . ,$22a_n$ has been arranged into the attenuation chamber 17. The overflows $22a_1$,$22a_2$, . . . ,$22a_n$ have a common air space 23. Each overflow has been formed preferably from a space fitted above the zones $12a_1$,$12a_2$, . . . in the intermediate chamber 12, which space comprises an air space common of the overflows $22a_1$,$22a_2$, . . . and separate overflow thresholds $180a_1$,$180a_2$, . . . for each overflow. Each overflow space is defined in relation to the adjacent spaces by means of partition walls $170a_1$,$170a_2$, . . . Thus, in accordance with the invention, by regulating the height of the overflow threshold $180a_1$,$180a_2$, . . . , it is possible to regulate the pressure that prevails in the zone $12a_1$, $12a_2$, . . . in the intermediate chamber 12, and in this way, by regulating the position of the overflow threshold, it is possible to regulate the flow quantity of the flow $Q_4$ departing from the compartments $12a_1$,$12a_2$, . . . The overflows are opened into a common exhaust duct $E_1$.

When the additional component flow $Q_1$ is introduced along the duct $20a_1$,$20a_2$, . . . into the pulp suspension component flow $Q_3$ of the average concentration of the headbox, the exhaust flow is produced as an overflow component $Q_2$. In such a case, the mixed flow $Q_4$ passed into and out of the turbulence generator 13 has a quantity equal to the component flow $Q_3$ coming out of the distribution tube $11a_1$,$11a_2$, . . . Thus, when the mixing ratio is regulated by bringing the additional component flow $Q_1$ into the component flow $Q_3$ along the duct $20a_1$,$20a_2$, . . . the flow quantity $Q_4$ passing into the turbulence tube $13a_2$,$13a_2$ of the turbulence generator 13 is kept invariable and constant. The quantity of the overflow $Q_2$ is equal to the quantity of the additional component flow $Q_1$ that was introduced.

The additional component flow $Q_1$ is preferably a flow consisting of water alone, i.e. a so-called O-water flow. The additional component flow $Q_1$ may also be a pulp flow whose concentration differs, on the whole, from the average concentration of the pulp suspension in the headbox and, thus, from the concentration of the component flow $Q_3$.

Figure 5B:
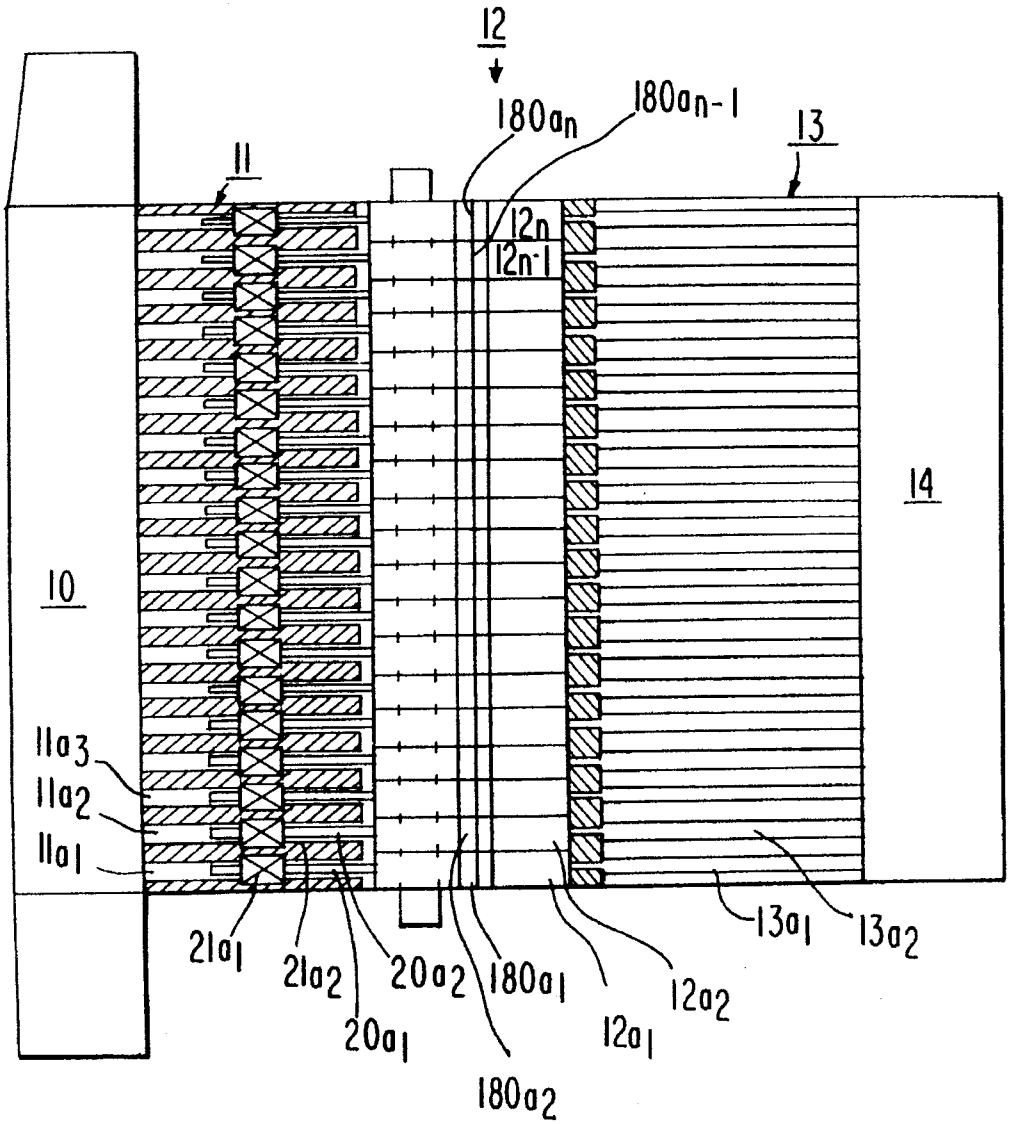
FIG. 5B is a sectional view taken along the line VI—VI in FIG. 5A.

FIG. 5B is a sectional view taken along the line VI—VI in FIG. 5A. As shown in FIG. 5B, each overflow zone or block $12a_1$,$12a_2$, . . . is defined by partition walls $170a_1$, $170a_2$, . . . The overflows of the zones $12a_1$,$12a_2$, . . . are opened into the common outlet E placed at the other side of the overflow threshold 180. Each additional-flow duct $20a_1$, $20a_2$, . . . comprises a valve $21a_1$,$21a_2$, . . . , in which case it is possible, in the direction of width of the paper machine, to adjust the desired mixing ratio for the subflows $Q_{4.1}$, $Q_{4.2}$,. . . , $Q_{4.n}$, of the combined total headbox pulp flow, at each location of width, which flow, as it comes out of the turbulence generator 13 out of its turbulence tube $13a_1$,$13a_2$, . . . acts further as a regulation flow at the desired location of width of the pulp suspension jet. The zones or blocks $12a_1$,$12a_2$, . . . ,$12a_n$ may be formed so that, at each location of width, the walls $170a_2$,$170a_3$ extend vertically from the lower part of the intermediate chamber in the headbox to its upper part and further into the overflow space, where they divide each overflow space into blocks at the zone of that location of width. The zones $12a_1$,$12a_2$, . . . ,$12a_n$ may also have been formed so that they comprise a bottom part D. In this case the blocks or zones $12a_1$,$12a_2$, . . . ,$12a_n$ have been formed into the intermediate chamber 12 of the headbox of the paper machine at each location of width in same and so that the blocks are placed in the upper part of the intermediate chamber 12 and are defined by the walls $170a_2$,$170a_3$ and by the bottom part D.

Figure 5C:
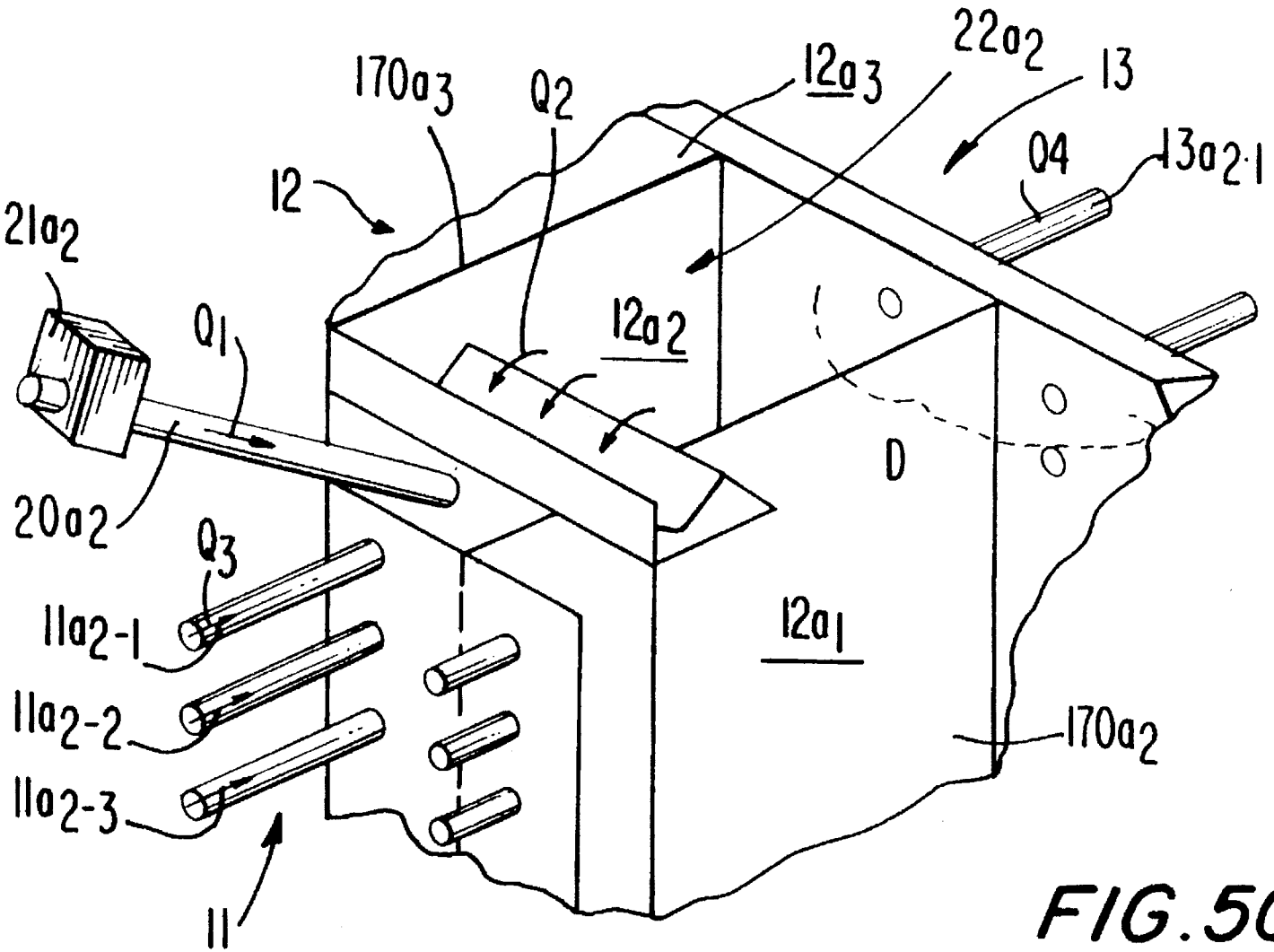
FIG. 5C is an axonometric illustration in part of the block construction in the direction of width of a paper/board machine as shown in FIGS. 5A and 5B.

FIG. 5C is an axonometric illustration in part of the arrangement in blocks of the headbox of a paper machine in the direction of width as illustrated above in order to permit regulation of the consistency and the fiber orientation of the pulp suspension at the desired location of width independently from one another.

Figure 6A:
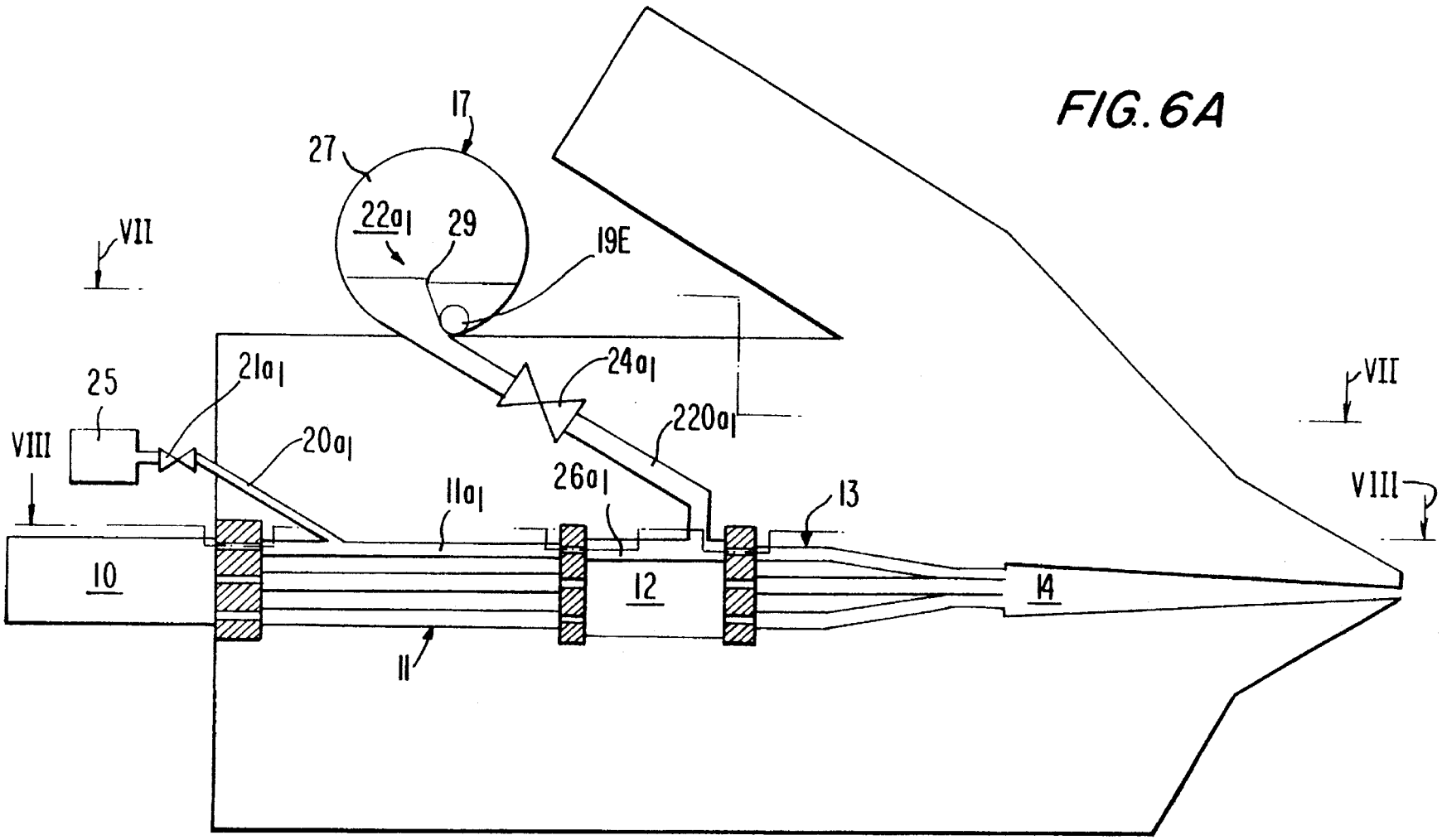
FIG. 6A is an illustration of principle and a sectional view of the headbox of a paper machine, which headbox comprises separate zones or blocks carried into effect by means of pipe connections and formed at different positions of width across the headbox of the paper/board machine.

FIG. 6A is an illustration of principle of the headbox of a paper machine, which headbox is in the other respects similar to the embodiment shown in FIGS. 5A, 5B and 5C, except that the arrangement in compartments has been carried out by means of pipe connections. For regulation of the quantity subflows $Q_{4.1}$, $Q_{4.2}$, a respective valve $24a_1$, $24a_2$ is arranged in each overflow pipe $220a_1$, $220a_2$, . . . In the embodiment of FIG. 6A, each additional subcomponent flow $Q_{1.1}$,$Q_{1.2}$, . . . ,$Q_{1.n}$ is passed from the inlet header 25, being regulated by the valves $21a_1$, $21a_2$, . . . placed in the additional-flow pipes $20a_1$,$20a_2$, . . . directly into the distribution tube $11a_1$,$11a_2$, . . . in the distribution manifold 11. The respective distribution tubes $11a_1$,$11a_2$, . . . pass further into a separate pipes $26a_1$,$26a_2$, . . . placed in the intermediate chamber 12, which pipes $26a_1$,$26a_2$, . . . are connected with an overflow pipe $220a_1$,$220a_2$, . . . The overflow pipe $220a_1$,$220a_2$, . . . is opened into an attenuation chamber 17 which comprises a collecting chamber 28 common of the overflows $220a_1$,$220a_2$. . . , a common air space 23, a common overflow threshold 29, and a common outlet E.

Figure 6B:
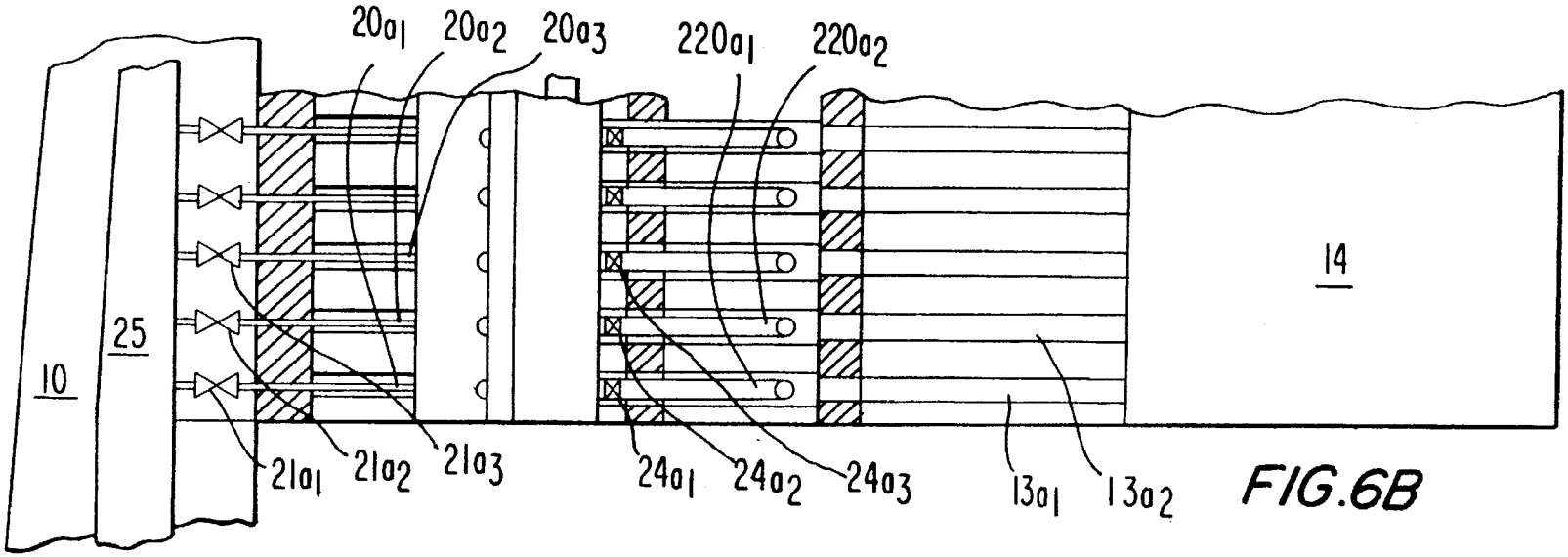
FIG. 6B is a sectional view taken along the line VII—VII in FIG. 6A.

FIG. 6B is a sectional view taken along the line VII—VII in FIG. 6A. The individual pipes $26a_1$,$26a_2$, . . . arranged in the intermediate chamber 12 prevent mixing of the combined component flow $Q_3$+$Q_1$ with the rest of the pulp flow in the intermediate chamber 12.

Figure 6C:
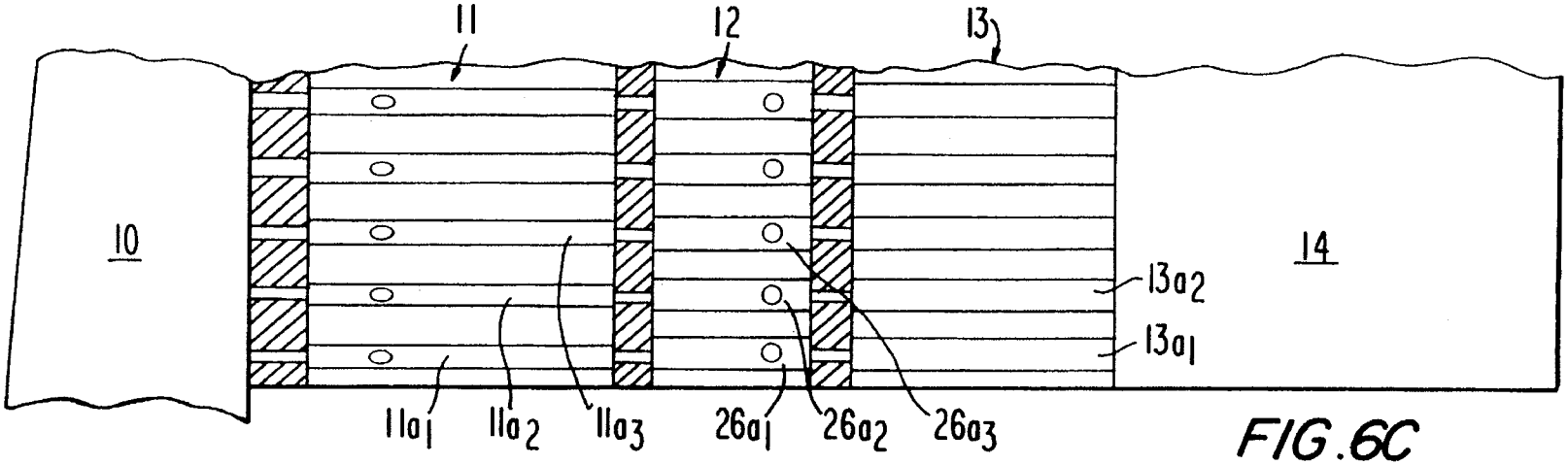
FIG. 6C is a sectional view taken along the line VIII—VIII in FIG. 6A.

FIG. 6C is a sectional view taken along the line VIII—VIII in FIG. 6A.

Figure 7A:
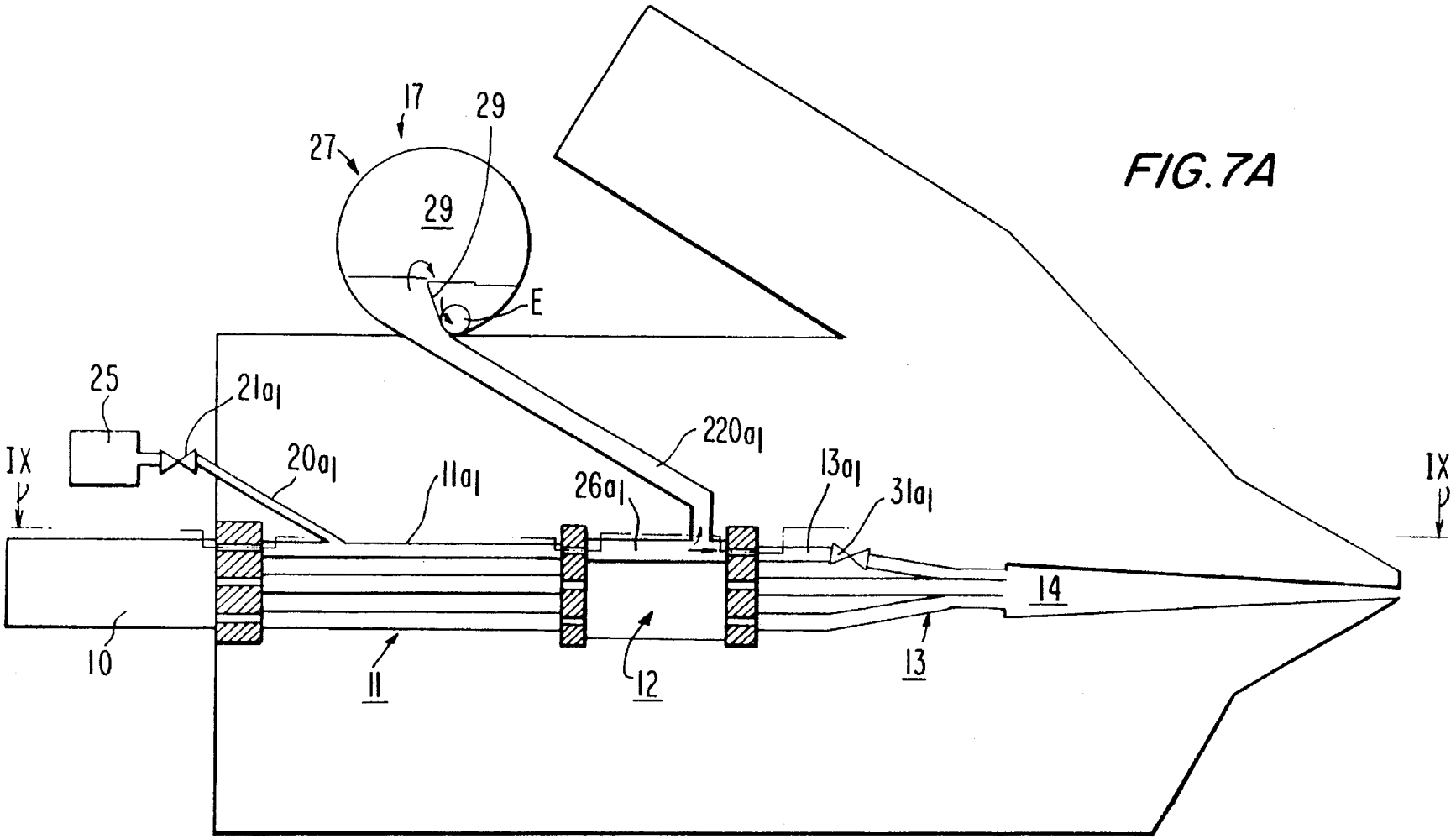
FIG. 7A shows an embodiment of the invention in which the flow quantity is regulated by means of valves arranged in the turbulence tubes in the upper row in the turbulence generator.

FIG. 7A shows an embodiment of the invention in which the flow quantity $Q_4$ is regulated by means of valves $31a_1$,$31a_2$, . . . ,$31a_n$, which are placed in respective turbulence tubes $13a_1$,$13a_2$, . . . adjacent to one another in the direction of width in the upper row in the turbulence generator 13.

Figure 7B:
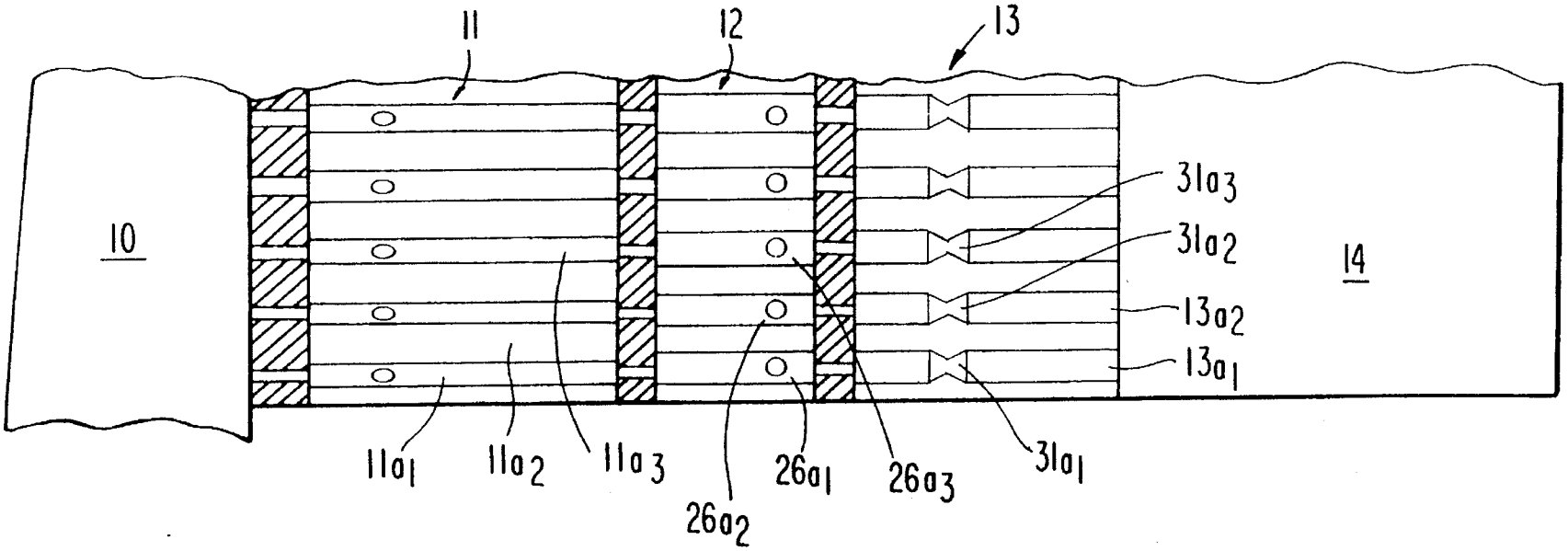
FIG. 7B is a sectional view taken along the line IX—IX in FIG. 7A.

FIG. 7B is a sectional view taken along the line IX—IX in FIG. 7A.

The examples provided above are not meant to be exclusive. Many other variations of the present invention would be obvious to those skilled in the art, and are contemplated to be within the scope of the appended claims.

We claim:

1. A method for regulating a total pulp flow from a headbox, said headbox comprising a pulp inlet header, a distributor manifold coupled to and arranged after said inlet header in a flow direction of the pulp, means defining an intermediate chamber, said distributor manifold having distribution pipes opening into said intermediate chamber, means defining an attenuation chamber arranged in connection with said intermediate chamber and a turbulence generator arranged after said intermediate chamber in the pulp flow direction, said turbulence generator including turbulence tubes having respective inlet ends opening into said intermediate chamber and respective outlet ends opening into a discharge duct, said total headbox pulp flow comprising a plurality of component flows through respective ones of said turbulence tubes, the method comprising the steps of:

forming at least one of said plurality of component flows from component subflows arranged at different locations in a direction transverse to a direction of flow of said at least one component flow, forming each of said component subflows from at least first and second subcomponent flows, directing each of said second subcomponent flows from said inlet header into a respective one of said turbulence tubes in said turbulence generator, introducing each of said first subcomponent flows into one of said second subcomponent flows at a point within one of said turbulence tubes in said turbulence generator at a certain mixing ratio, said introducing step comprising the steps of arranging a mixing chamber in each of said turbulence tubes, passing one of said second subcomponent flows from said intermediate chamber through a separate pipe arranged in each of said mixing chambers, an inlet end of each of said pipes opening into said intermediate chamber and an outlet end of each of said pipes opening into a respective one of said mixing chambers, passing a respective one of said first subcomponent flows annularly from around said pipe into an end of the respective one of said mixing chambers, and regulating the concentration of each of said subflows by adjusting the flow rates of said first subcomponent flow and said second subcomponent flow, which constitute said subflow, relative to one another.

2. The method of claim 1, further comprising the steps of:

arranging said turbulence tubes in a transverse direction of said headbox, and passing each of said first subcomponent flows into one of said turbulence tubes in said turbulence generator.

3. The method of claim 1, further comprising the steps of:

passing said second subcomponent flows from said intermediate chamber before said first subcomponent flows are introduced into said second subcomponent flows, and throttling each of said first subcomponent flows by means of a valve to vary the rate of flow of each of said first subcomponent flows into a respective one of said second subcomponent flows.

4. The method of claim 1, wherein said second subcomponent flows comprise a pulp flow, further comprising the steps of:

passing each of said second subcomponent flows out of said intermediate chamber into one of said turbulence tubes, providing said second subcomponent flows with a concentration corresponding to an average concentration of pulp suspension in said headbox, and providing said first subcomponent flows as a water flow.

5. The method of claim 1, further comprising the step of passing said first subcomponent flows from an additional inlet header into a respective one of additional-flow pipes arranged in different locations in the transverse direction of said headbox.

6. The method of claim 1, further comprising the steps of:

coupling said mixing chamber to said intermediate chamber, and passing said subflow constituting a combination of one of said first subcomponent flows and one of said second subcomponent flows from said mixing chamber into a first duct portion of the respective one of said turbulence tubes, said first duct portion having a sectional flow area smaller than the sectional flow area of said mixing chamber.

7. The method of claim 6, further comprising the step of passing each of said second subcomponent flows from said intermediate chamber into said mixing chamber through a second duct portion of a respective one of said turbulence tubes, said second duct portion having a sectional flow area substantially smaller than the sectional flow area of said mixing chamber.

8. The method of claim 1, wherein said first subcomponent flows are a diluting flow and each of said turbulence tubes has a first duct portion arranged after said mixing chamber in the pulp flow direction, said first duct portion having a sectional flow area smaller than the sectional flow area of said mixing chamber, further comprising the step of passing said subflow thus formed from said at least one of said first component flows and said one of said second component flows to said discharge duct.

9. The method of claim 8, further comprising the steps of:

arranging a flange on said outlet end of said pipe, said flange projecting from a face plane of said pipe, and throttling said first subcomponent flows by means of said flange before each of said first subcomponent flows is mixed with the respective one of said second subcomponent flows.

10. The method of claim 1, further comprising the step of regulating the grammage of a web formed from said total headbox pulp flow only by regulating said first subcomponent flows.

11. The method of claim 1, further comprising the steps of:

throttling each of said first subcomponent flows by means of a valve to reduce or increase the rate of flow of each of said first subcomponent flows into a respective one of said second subcomponent flows, passing said at least one of said component flows into said discharge duct, prior to passing said at least one of said component flows to said discharge duct, removing as overflow a portion of said at least one of said component flows after said first and second subcomponent flows have been combined, whereby if the combined flow rate of said first and second subcomponent flows is increased based on an increase in the flow rate of said first subcomponent flow, the excess amount is removed as overflow so that the rate of flow of said at least one of said component flows into said discharge duct remains constant.

12. The method of claim 11, further comprising the steps of:

passing said at least one of said component flows after the overflow has been removed to said turbulence generator, providing said second subcomponent flows with a concentration corresponding to an average concentration of pulp suspension in said head box, and providing said first subcomponent flows as a water flow.

13. The method of claim 11, further comprising the step of dividing said intermediate chamber into a plurality of isolated compartments in the transverse direction of the at least one component flow such that at least one of said component flows enters into each of said compartments whereby mixing of said component flows in the transverse direction of the at least one component flow is prevented.

14. The method of claim 11, further comprising the steps of:

dividing said intermediate chamber into zones or blocks by means of partition walls, one of said component flows passing through each of said zones or blocks, and arranging separate removal means to remove the overflow of each of said component flows from respective ones of said zones or blocks.

15. The method of claim 14, further comprising the step of regulating the flow rate of said component flows by regulating the overflow for respective ones of said removal means.

16. The method of claim 14, further comprising the steps of:

arranging separate valve means associated with respective ones of said removal means, and regulating the flow rate of each of said component flows by regulating said valve means.

17. The method of claim 15, further comprising the steps of:

arranging valve means in a path of said component flows after said component flows have been passed through said turbulence generator, and regulating the rate of flow of said component flows by regulating the throttle of said valve means and thus the flow resistance of the flow.

18. The method of claim 11, further comprising the steps of:

passing each of said first subcomponent flows directly into a respective one of said distribution pipes in said distribution manifold, and passing each of said first subcomponent flows from said distribution pipes through a pipe in said intermediate chamber and into a respective one of said turbulence tubes.

19. The method of claim 11, further comprising the step of passing each of said first subcomponent flows out of said inlet header into a respective one of additional-flow pipes arranged in the transverse direction of said headbox.

20. In a headbox comprising a pulp inlet header, a distributor manifold coupled to and arranged after said inlet header in a direction of pulp flow, said distributor manifold having distributor pipes opening into an intermediate chamber, and said intermediate chamber being coupled to an attenuation chamber for regulating the pressure of pulp in said intermediate chamber, said intermediate chamber being followed by a turbulence generator in the pulp flow direction, said turbulence generator having turbulence tubes opening into a discharge duct, the improvement comprising;

a device for regulating a total pulp flow from the headbox, said device comprising means for directing at least one pulp component flow from said turbulence generator to provide said total headbox pulp flow, means for forming component subflows of said at least one component flow arranged at different locations in a direction transverse to a direction of flow of said at least one component flow, each of said component subflows being formed from at least first and second subcomponent flows, means for regulating the flow of each of said first subcomponent flows relative to the flow of a respective one of said second subcomponent flows to thereby regulate the concentration of said component subflows and thus said at least one component flow so as to adjust the grammage of a web formed from said total headbox pulp flow to a desired level in said transverse direction, said regulation means comprising;

means for passing each of said second subcomponent flow from said inlet header to a respective one of said turbulence tubes in said turbulence generator, additional-flow duct means for directing each of said first subcomponent flows into one of said second subcomponent flows within one of said turbulence tubes in said turbulence generator, said additional-flow duct means communicating with said turbulence tubes of said turbulence generator such that said first subcomponent flows are carried into different positions in the transverse direction of said turbulence generator, means for regulating the flow of said first subcomponent flows through said additional-flow duct means, and means defining a mixing chamber arranged in said turbulence tubes of said turbulence generator, said additional-flow duct means being connected to said mixing chamber.

21. The device of claim 20, wherein said additional-flow duct means comprise valves which regulate the flow resistance and rate of flow of each of said first subcomponent flows.

22. The device of claim 20, wherein at least one of said turbulence tubes comprises a first duct portion arranged after said mixing chamber in the pulp flow direction, and a second duct portion following said first duct portion in the pulp flow direction, said second duct portion having a sectional flow area which is substantially smaller than the sectional flow area of said first duct portion.

23. The device of claim 20, wherein at least one of said turbulence tubes comprises a flow duct portion arranged between said mixing chamber and said intermediate chamber, said flow duct portion having a smaller sectional flow area in comparison with the sectional flow area of said mixing chamber.

24. The device of claim 20, further comprising a flange piece having a throttle-duct portion arranged in at least one of said turbulence tubes, said flange piece being mounted by a threaded joint or a press fitting at a mouth of said at least one turbulence tube.

25. The device of claim 24, wherein said throttle-duct portion comprises at least two duct portions, a first one of said duct portions comprising a straight duct portion having a constant sectional flow area and a second one of said duct portions comprising a conically widening duct portion connected to said mixing chamber.

26. The device of claim 20, further comprising an annular pipe in flow communication between said mixing chamber and said intermediate chamber, said annular pipe being arranged in relation to said mixing chamber such that each of said first subcomponent flows is passed annularly between an outer face of said mixing chamber and said pipe into a mixing point placed at an end of said pipe and being combined at said mixing point with a respective one of said second subcomponent flows, said pipe being opened at an inlet end into said intermediate chamber and at an outlet end opposite to said inlet end being opened into one of said turbulence tubes and an inlet of said mixing chamber.

27. The device of claim 25, wherein said pipe comprises a flange connected to a recess in a front face at an inlet-side end of said turbulence generator, said flange being placed facing said intermediate chamber.

28. The device of claim 26, wherein said pipe comprises a throttle flange arranged at said outlet end, said throttle flange throttling said first subcomponent flow prior to combining of said first subcomponent flow with the respective one of said second subcomponent flows.

29. The device of claim 20, wherein said additional-flow duct means comprise two additional-flow pipes opening into said mixing chamber, subflows of said first subcomponent flow being passed through both of said additional-flow pipes into said mixing chamber to be mixed with said second subcomponent flow.

30. The device of claim 20, wherein said additional-flow ducts means comprise pipes, said additional-flow pipes being connected to said turbulence tubes of said turbulence generator in a substantially perpendicular direction, such that said first subcomponent flow and said second subcomponent flow meet each other substantially perpendicular to one another.

31. In a headbox comprising a pulp inlet header, a distributor manifold coupled to and arranged after said inlet header in a direction of pulp flow, said distributor manifold having distributor pipes opening into an intermediate chamber, and said intermediate chamber being coupled to an attenuation chamber for regulating the pressure of pulp in said intermediate chamber, said intermediate chamber being followed by a turbulence generator in the pulp flow direction, said turbulence generator having turbulence tubes opening into a discharge duct, the improvement comprising;

a device for regulating a total pulp flow from the headbox, said device comprising means for directing at least one pulp component flow from said turbulence generator to provide said total headbox pulp flow, means for forming component subflows of said at least one component flow arranged at different locations in a direction transverse to a direction of flow of said at least one component flow, each of said component subflows being formed from at least first and second subcomponent flows, means for regulating the flow of each of said first subcomponent flows relative to the flow of a respective one of said second subcomponent flows to thereby regulate the concentration of said component subflows and thus said at least one component flow in order to adjust the grammage of a web formed from said total headbox pulp flow to a desired level in said transverse direction, said regulation means comprising;

means for passing each of said second subcomponent flows from said inlet header to a respective one of said turbulence tubes in said turbulence generator, and additional-flow duct means for directing each of said first subcomponent flows into a respective one of said second subcomponent flows within one of said turbulence tubes in said turbulence generator, said additional-flow duct means communicating with said turbulence tubes of said turbulence generator such that said first subcomponent flows are carried into different positions in the transverse direction of said turbulence generator, the device further comprising;

means for preventing said component subflows from mixing together, said mixing preventing means comprising zones formed in the transverse direction of said at least one component flow, each of said zones having an overflow for maintaining the flow rate of subflows of said at least one component flow being passed from said zones constant.

32. The device of claim 30, wherein said additional-flow duct means comprise valves for regulating the flow resistance and thus the rate of flow of said first subcomponent flows, said zones being formed in said intermediate chamber.

33. The device of claim 30, wherein each of said overflows comprises means by which the overflow is regulated such that the rate of flow of said component subflows being passed from said intermediate chamber are regulated.

34. The device of claim 30, wherein each of said zones is connected with said turbulence generator such that at least one of said turbulence tubes is arranged in flow communication with each of said zones.

35. The device of claim 30, wherein said additional-flow duct means comprise an additional-flow duct connected directly with one of said distribution tubes of said distribution manifold.

36. The device of claim 30, wherein said additional-flow duct means comprise an annular pipe through which said at least one of said plurality of component flows passes, an overflow duct connected to said annular pipe, and a valve position & arranged for regulating the overflow passing through said overflow duct.

37. The device of claim 35, wherein said annular pipe is arranged in said intermediate chamber such that through said annular pipe, said at least one of said plurality of component flows is passed from a distribution tube of said distribution manifold into a respective one of said turbulence tubes of said turbulence generator.

38. The device of claim 30, further comprising a valve arranged in each of said turbulence tubes, said valve regulating the flow resistance and the rate of flow of said at least one of said plurality of component flows.

39. The device of claim 30, wherein each of said overflows comprises an overflow threshold having an adjustable height position.

40. A method for regulating a total pulp flow from a headbox, said headbox comprising a pulp inlet header, a distributor manifold coupled to and arranged after said inlet header in a flow direction of the pulp, means defining an intermediate chamber, said distributor manifold having distribution pipes opening into said intermediate chamber, means defining an attenuation chamber arranged in connection with said intermediate chamber and a turbulence generator arranged after said intermediate chamber in the pulp flow direction, said turbulence generator including turbulence tubes having respective inlet ends opening into said intermediate chamber and respective outlet ends opening into a discharge duct, said total headbox pulp flow comprising a plurality of component flows through respective ones of said turbulence tubes, the method comprising the steps of:

forming at least one of said plurality of component flows from component subflows arranged at different locations in a direction transverse to a direction of flow of said at least one component flow, forming each of said component subflows from at least first and second subcomponent flows, directing each of said second subcomponent flows from said inlet header into a respective one of said turbulence tubes in said turbulence generator, introducing each of said first subcomponent flows into one of said second subcomponent flows at a point within one of said turbulence tubes in said turbulence generator at a certain mixing ratio, said introducing step comprising the steps of passing at least one of said first subcomponent flows into a mixing chamber in at least one of said turbulence tubes of said turbulence generator, coupling said mixing chamber to said intermediate chamber, and passing said subflow constituting a combination of said at least one of said first subcomponent flows and one of said second subcomponent flows from said mixing chamber into a first duct portion of said at least one of said turbulence tubes having a sectional flow area smaller than the sectional flow area of said mixing chamber, and regulating the concentration of each of said subflows by adjusting the flow rates of said first subcomponent flow and said second subcomponent flow which constitute said subflow relative to one another.

41. The method of claim 39, further comprising the step of passing each of said second subcomponent flows from said intermediate chamber into said mixing chamber through a second duct portion of each of said at least one of said turbulence tubes, said second duct portion having a sectional flow area substantially smaller than the sectional flow area of said mixing chamber.

42. In a headbox comprising a pulp inlet header, a distributor manifold coupled to and arranged after said inlet header in a direction of pulp flow, said distributor manifold having distributor pipes opening into an intermediate chamber, and said intermediate chamber being coupled to an attenuation chamber for regulating the pressure of pulp in said intermediate chamber, said intermediate chamber being followed by a turbulence generator in the pulp flow direction, said turbulence generator having turbulence tubes opening into a discharge duct, the improvement comprising;

a device for regulating a total pulp flow from the headbox, said device comprising means for directing at least one pulp component flow from said turbulence generator to provide said total headbox pulp flow, means for forming component subflows of said at least one component flow arranged at different locations in a direction transverse to a direction of flow of said at least one component flow, each of said component subflows being formed from at least first and second subcomponent flows, means for regulating the flow of each of said first subcomponent flows relative to the flow of a respective one of said second subcomponent flows to thereby regulate the concentration of said component subflows and thus said at least one component flow so as to adjust the grammage of a web formed from said total headbox pulp flow to a desired level in said transverse direction, said regulation means comprising;

means for passing each of said second subcomponent flows from said inlet header to a respective one of said turbulence tubes in said turbulence generator, additional-flow duct means for directing each of said first subcomponent flows into a respective one of said second subcomponent flows within one of said turbulence tubes in said turbulence generator, said additional-flow duct means communicating with said turbulence tubes of said turbulence generator such that said first subcomponent flows are carried into different positions in the transverse direction of said turbulence generator, means defining a mixing chamber arranged in each of said turbulence tubes of said turbulence generator and connected to said additional-flow duct means, and an annular pipe in flow communication with each of said mixing chambers and said intermediate chamber and being opened at an inlet end into said intermediate chamber and at an outlet end opposite to said inlet end into said mixing chamber so that each of said first subcomponent flows is passed annularly between an inner face of said mixing chamber and one of said annular pipes into said mixing chamber to combine with a respective one of said second subcomponent flows.

43. The device of claim 41, wherein each of said annular pipes comprises a flange connected to a recess in a front face at an inlet-side end of said turbulence generator, said flange being placed facing said intermediate chamber.

44. The device of claim 41, wherein each of said annular pipes comprises a throttle flange arranged at said outlet end, said throttle flange throttling said first subcomponent flow prior to combining of said first subcomponent flow with said second subcomponent flow.

* * * * *